US010502538B1

(12) United States Patent
Thuman et al.

(10) Patent No.: US 10,502,538 B1
(45) Date of Patent: Dec. 10, 2019

(54) PRE-FRAGMENTATION OF WARHEAD

(71) Applicant: BAE SYSTEMS BOFORS AB, Karlskoga (SE)

(72) Inventors: Christer Thuman, Karlskoga (SE); Abraham Langlet, Stockholm (SE); Ulf Heiche, Karlskoga (SE)

(73) Assignee: BAE SYSTEMS BOFORS AB, Karlskoga (SE)

( * ) Notice: Subject to any disclaimer, the term of this patent is extended or adjusted under 35 U.S.C. 154(b) by 310 days.

(21) Appl. No.: 14/999,931

(22) Filed: Apr. 26, 2017

(30) Foreign Application Priority Data

Jun. 17, 2015 (SE) ..... 1530091

(51) Int. Cl.
*F42B 12/22* (2006.01)
*F42B 12/32* (2006.01)

(52) U.S. Cl.
CPC ..... *F42B 12/22* (2013.01); *F42B 12/32* (2013.01)

(58) Field of Classification Search
CPC ..... F42B 12/02; F42B 12/22; F42B 12/32
See application file for complete search history.

(56) References Cited

U.S. PATENT DOCUMENTS 3,815,504 A * 6/1974 Tieben ..... F42B 12/32 102/496
3,945,321 A * 3/1976 Mayer ..... F42B 12/32 102/496
4,112,847 A * 9/1978 Thomanek ..... F42B 23/16 102/205
4,129,061 A * 12/1978 Bedall ..... F42B 12/32 102/496
4,327,643 A * 5/1982 Lasheras Barrios .... F42B 12/32 102/473
4,524,696 A * 6/1985 Altenau ..... F42B 12/32 102/473

(Continued)

FOREIGN PATENT DOCUMENTS

DE 1943472 A1 * 3/1971 ..... F42B 12/32
DE 2129196 A1 * 1/1973 ..... F42B 12/32

(Continued)

*Primary Examiner* — Benjamin P Lee
(74) *Attorney, Agent, or Firm* — Buchanan Ingersoll & Rooney PC

(57) ABSTRACT

The invention relates to method for pre fragmentation of a warhead (1) comprising a warhead body (2), an explosive charge (6), a fin part (3), and a warhead shell (4) with the density $\rho_{shell}$ wherein the warhead shell (4) comprises pre formed cavities (5), where each cavity (5) comprises at least one pre formed projectile (7) with the density $\rho_{proj}$ and filler material or agent (8) with the density $\rho_{fill}$, wherein the method comprises the following steps: —pre formation of the cavities (5) in the warhead shell (4), —arrangement of at least one projectile (7) in each pre formed cavities (5), —filling of filler material or agent (8) in the cavities (5) so that the cavities (5) are filled, —treatment of the filler material or agent (8) so that the filler material or agent (8) forms a connected structure vid high adhesiveness to the projectiles (7) and to the walls of the cavity (5). The invention further relates to a pre fragmented warhead.

17 Claims, 2 Drawing Sheets

(56) References Cited

Figure 1:
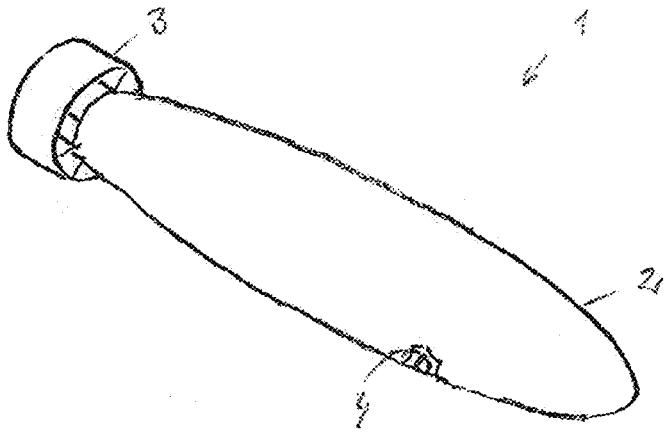

U.S. PATENT DOCUMENTS 4,644,867 A * 2/1987 Hellner ..... F42B 12/32
102/495
4,917,016 A * 4/1990 Rudolf ..... F42B 12/14
102/476
4,982,668 A * 1/1991 Bender ..... F42B 12/32
102/495
5,594,197 A * 1/1997 Lindstadt ..... F42B 12/32
102/473
5,979,332 A * 11/1999 Hammer ..... F42B 12/32
102/496
8,276,520 B1 * 10/2012 Fong ..... F42B 12/22
102/491
8,381,657 B1 * 2/2013 Hooke ..... F42B 8/26
102/481
8,689,669 B2 * 4/2014 Ronn ..... F42B 12/32
102/496
9,759,533 B2 * 9/2017 Bruno ..... F42B 12/32
10,018,453 B1 * 7/2018 McCoy ..... F42B 12/24
2003/0164108 A1 * 9/2003 Ronn ..... F42B 12/10
102/473
2009/0211484 A1 * 8/2009 Truitt ..... F42B 12/32
102/497
2014/0224145 A1 * 8/2014 Burky ..... F42B 12/22
102/476
2016/0258727 A1 * 9/2016 Bruno ..... F42B 12/24
2016/0349027 A1 * 12/2016 Kerns ..... F42B 12/34
2018/0112960 A1 * 4/2018 Miller ..... F42B 12/24
2018/0252508 A1 * 9/2018 Rastegar ..... F42B 12/32
2019/0025030 A1 * 1/2019 Grunder ..... F42B 12/22

FOREIGN PATENT DOCUMENTS

DE 2310667 A1 * 9/1974 ..... F42B 12/26
DE 2919268 A1 * 11/1980 ..... F42B 12/22
DE 19855537 A1 * 3/2000 ..... F42B 12/24

* cited by examiner

PRE-FRAGMENTATION OF WARHEAD

The present invention relates to a method for pre fragmentation of a warhead. The invention further relates to a pre fragmented warhead.

Weapon systems for combating targets in air, on sea or on ground comprises different types of ballistic warheads such as grenades fired from barrel, robots or missiles of different kinds or gliding bombs launched from aircrafts. Pre fragmentation of a warhead, such as a grenade, by applying pre formed projectiles, also known as fragmentation units, with high density, in pre formed cavities in the shell of the grenade is previously known to improve the effect in target. From the weapon effects perspective a pre fragmented grenade or bomb is more effective and more predictable than a natural fragmented grenade or bomb. Despite this, weapon systems with natural fragmented warheads still exist.

For a lot of the known weapon systems a need exists to replace natural fragmented warheads with pre fragmented warheads.

By upgrading a weapon system, according to above, it has been shown that the warheads have been to heavy or to light which have affected the moment of inertia of the warhead and the ballistic performance of the weapon system.

This have thus lead to high cost of integration due to the need of modification or exchange of the weapon systems control system due to the changed ballistic performance.

It thus exist a need of an improved pre fragmentation method where the above mentioned drawbacks are reduced or completely eliminated.

After pre fragmentation it is a requirement that the projectiles should not be broken or deformed during acceleration when the war head burst. The velocity of the projectiles should initially be high when the projectiles leave the war head. At the same time the projectiles should be designed to avoid that the projectiles velocity is not reduced to fast on the way to the target and thus could reach high weapon effect in the target.

For a weapon system where the war head is a grenade fired from a barrel the war head must be able to withstand the high acceleration and centrifugal forces occurring during launch The shell of the grenade should act as a driving mirror for the projectiles when the projectiles leave the grenade and contribute to that the projectiles are accelerated to a high and even velocity in predetermined directions.

By document U.S. Pat. No. 4,644,867 it is known of a grenade where the shell of the grenade includes preformed fragmentation units with high density mixed with a carrier material, preferably a metal powder. The preformed fragmentation units comprise together with the metal powder a connected shell enclosing the explosives in the grenades body.

The shell of the grenade is manufactured by a powder metallurgy process where the carrier material is mixed with the fragmentation units and pressed under high pressure and high temperature to a dense shell. The shell of the grenade forms a connected structural member that withstands the axial and radial forces acting upon the shell upon launch.

The process as described where the carrier material and the fragmentation units are mixed under high pressure and high temperature results in that the position of the fragmentation units within the carrier material could vary between different grenades. The high pressure could also results in variations in the outer geometry of the shell which affects the ballistic performance of the grenade. Further could the high temperature result in that the fragmentation elements material characteristics are changed.

Purpose of the Invention and its Distinctive Features

The purpose of the present invention is to improve a method for pre fragmentation of a warhead comprising a warhead body, an explosive charge, a fin part, and a warhead shell with the density $\rho_{shell}$ wherein the warhead shell comprises pre formed cavities, where each cavity comprises at least one pre formed projectile with the density $\rho_{proj}$ and filler material or agent with the density $\rho_{fill}$, wherein the method comprises the following steps:

- pre formation of the cavities in the warhead shell,
- arrangement of at least one projectile in each pre formed cavities,
- filling of filler material or agent in the cavities so that the cavities are filled,
- treatment of the filler material or agent so that the filler material or agent forms a connected structure vid high adhesiveness to the projectiles and to the walls of the cavity.

According to further aspects of the improved method of pre fragmentation of a warhead provision is made as follows:

- the dimensions of the projectiles and the cavities and the density of the projectiles and the filler material or agent are selected so that the mass of the warhead before pre fragmentation remains the same as after pre fragmentation.
- the density of the filler material or agent, the warhead shell, and the projectiles are selected to fulfil the relation $\rho_{fill}<\rho_{shell}<\rho_{proj}$.
- the cavities are mechanically pre formed in the warhead shell by drilling or milling.
- the filler material or agent are treated to a strong and continuous structure by heat and pressure treatment.
- the filler material or agent are treated to a strong and continuous structure by a curing treatment.
- the positions of the cavities on the warhead shell are selected depending upon the mechanical strength of the warhead shell by utilizing a topological optimization method.

The invention also relates to an improved pre fragmented warhead comprising a warhead body, a fin part, an explosive charge, and a warhead shell, with the thickness $t_{shell}$ and the density $\rho_{shell}$, wherein the warhead shell comprises projectiles with the density $\rho_{proj}$ and filler material or agent with the density $\rho_{fill}$, wherein the dimensions of the projectiles and the cavities and the density of the projectiles and the filler material or agent are selected so that the mass of the warhead before pre fragmentation remains the same as after pre fragmentation.

According to further aspects of the improved pre fragmented warhead provision is made as follows:

- the filler material or agent, the warhead shell, and the projectiles are selected to fulfil the relation $\rho_{fill}<\rho_{shell}<\rho_{proj}$.
- the projectiles are spherical with the diameter $d_{proj}$, and that the cavities are cylindrically shaped with the length $l_{cav}$ and the diameter $d_{cav}$, and where $d_{proj}<d_{cav}$.
- the projectiles comprises an alloy of wolfram.
- the filler material or agent comprises a magnesium powder.
- the filler material or agent comprises an aluminium powder.
- the filler material or agent comprises a zirconium powder.
- the filler material or agent comprises a thermosetting plastic.

the warhead comprises a second warhead shell arranged on the first warhead shell.

the warhead is a bomb.

the warhead is a grenade.

Benefits and Effects of the Invention

The improved method of pre fragmentation results in several advantages and effects of which the most important are:

A reduced cost of integration to existing weapon systems since the pre fragmented war head have the same mass, moment of inertia and outer geometry as the replaced natural fragmented war head. Existing war head could be exchanged and replaced by an equivalent high effect alternative without costly modification of the weapon system.

An improved weapon effect without modification or replacement of the weapon systems other sub systems resulting in minimized or eliminated cost for integration and thus a reduced number of war heads for the combatting of a target.

An improved weapons effect since an existing war head could be replaced by a warhead with heavy alloy projectiles.

An unchanged initial velocity of the projectiles compared to the original performance since the accelerated mass is unchanged.

The possibility to arrange a grenade or bomb with asymmetrically arranged projectiles, for example only on one side of the projectile without changing the centre of gravity of the projectile.

Shock wave reduction since the projectiles achieves a certain protection against the initial shock wave due to the difference in mechanical impedance between material layers of different density.

The exact positioning of the cavities on the shell of the warhead allows the weapon effect of the war head to be optimized with respect to the mechanical strength of the shell.

Additional benefits and effects according to the invention will be presented in this study and by the observance of the following detailed description of embodiments including a number of the most advantageous embodiments, patent claims and the attached drawings where:

FIG. 1. shows schematic a view from the side of a warhead with projectiles arranged in the shell of the warhead.

Figure 2:
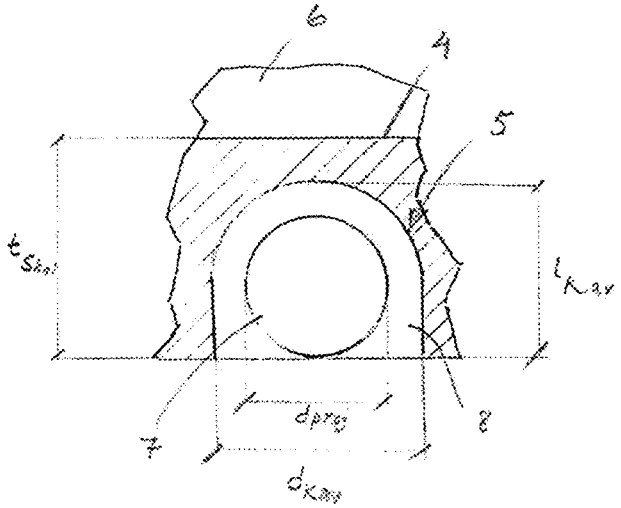

FIG. 2. shows schematic a part enlargement of one projectile arranged in a cavity with filling agent in the shell of the warhead according to FIG. 1.

Figure 3:
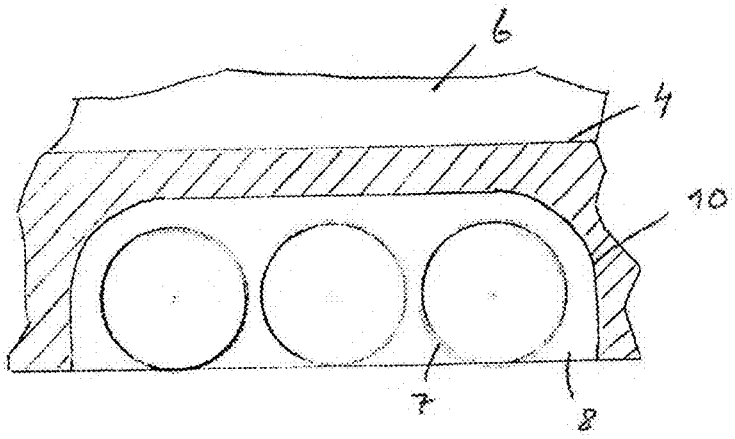

FIG. 3. shows schematic a part enlargement of three projectiles arranged in a cavity with filling agent in the shell of the warhead according to FIG. 2.

Figure 4:
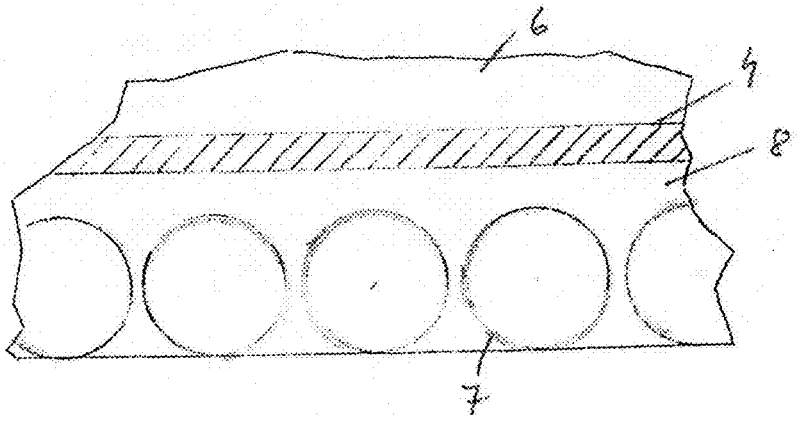

FIG. 4. shows schematic a part enlargement projectiles arranged in filling agent in the shell of the warhead according to FIG. 2.

DETAILED DESCRIPTION OF EMBODIMENTS

Pre fragmentation according to the invention means that cavities are pre formed in the shell or cover of the body of a warhead such as a bomb. In the cavities projectiles are arranged, such as spheres, cubes, rods or cylinders with high density. The projectiles are surrounded with a filling agent or material with low density in an amount so that the cavities are filled. The projectiles and the cavities dimensions and the density of the projectiles and the filling agent are selected so that the mass of the bomb is kept constant after pre fragmentation as before pre fragmentation.

To fulfil demands on weapon effect the projectile comprises a material of high density and preferably a heavy alloy such as an alloy comprising wolfram, also known as tungsten. Other materials and alloys with high density could also be used. The filling agent or material comprises a material of low density preferably a compressed and heat treated metal powder comprising, for example, manganese and/or aluminium or a mixture of manganese and aluminium. The filling agent or material could also be a thermosetting plastic, for example an isocyanate curing polyurethane plastic. The filling agent or material could also comprise several layers of materials of different density.

FIG. 1 shows a bomb 1, or a warhead 1, arranged to be dropped from an airplane. The bomb 1 comprises a bomb body 2, or a warhead body 2, and a rear fin part 3. The bomb body 2 comprises an outer bombshell 4, or a warhead shell 4, enclosing an inner explosive charge 6. Cavities 5 of defined size and form are arranged in the bombshell 4. The cavities 5 are pre formed on the bombshell 4 on predefined positions on the bomb 1.

At least one projectile 7 of defined form, size and density is arranged in each cavity 5. The projectiles 7 are preferably heavy alloy spheres but other types of projectiles 7 are also possible to use.

A filler agent or material 8 of defined amount, with a specific density is arranges surrounding the projectiles 7 in the cavities 5. The method of pre fragmentation comprises the following steps: arrange or pre-form cavities in the bombshell 4 of the bomb body 2. Apply projectiles 7 in the cavities 5.

Filling of the filler agent or material 8 in the cavities 5, surrounding the projectiles 7, in an amount so that the filler agent or material completely fills the cavity 5. Treatment of the filler material or agent 8 so that the filler material or agent 8 forms a connected structure vid high adhesiveness to the projectiles 7 and to the walls of the cavity 5.

Pre forming of the cavities 5 in the bombshell 4 are preferably done by mechanical machining such as drilling or milling. As an alternative the machining could also comprises laser ablation. It is also possible to combine different types of machining.

In an alternative embodiment the bomb 1 comprises a second bombshell fixedly arranged on top of the first bombshell 4 where the second bombshells function is to secure that the projectiles 7 are kept in the cavities 5 during rotation of the bomb 1. The second bombshell is preferably a pre formed metal shell of steel or plastic arranged to cover, in part or completely, the first bombshell and arranged to be possible to mount directly on the first bombshell by, for example, thermal expansion or alternative by other mounting means such as a snap mount.

As shown in FIG. 2 the projectiles 7 are arranged in cylindrical shaped cavities 5 with a circular cross section arranged on defined distances from each other where the bottom of the cavity 5 is half spherical. As an alternative the cavities 5 could be arranged with a square or rectangular cross section and the bottom of the cavity 5 could be arranged as a cone where the cone formed bottom of the cavity 5 contribute to centring of the projectile 7 to the centre position of the cavity 5.

A cone shaped bottom does also contribute to that the filler agent or material 8 is better distributed around the projectile 7 during the filling operation.

In FIGS. 3 and 4 two alternative embodiments of a bombshell 4 according to the invention are shown. FIG. 3 shows an embodiment with a bigger cavity 10 shaped to comprise three projectiles 7, instead of one projectile, and a surrounding filler agent or material 8. The bigger cavity 10 imply a more compact shell of the projectile and a simplified method of pre fragmentation compared to the embodiment as shown in FIG. 2.

FIG. 4 shows an embodiment with mass neutral in-built projectiles 7 in the bomb body 4 without the pre formed cavities. With mass neutral in-built projectiles it is possible to arrange the projectiles 7 on one side of the bomb body 4 without affecting the moment of inertia or centre of gravity of the bomb 1. If the bomb 1 could turn a predetermined side of the bomb towards the target, with help from the control system, and at the same time have the capacity to detonate at the right moment in time this can be used to turn the right side, arranged with project, at the right moment in time, towards the target.

An additional benefit of mass neutral built-in projectiles, as shown in FIG. 4, is that naturally splinter fragments generated from the side of the bomb 1 that lacks projectiles 7 are reduced in speed faster than the projectiles 7 which are advantageously from an MCD perspective (MCD—Minimum Collateral Damage) and that the area of risk is reduced. An advantage with this is that the bomb 1 only needs projectiles on one side of the bomb 1 which is economically advantageous.

In an additional embodiment, not shown, more than three projectiles 7 are arranged in the same cavity.

The projectiles could be of the same or different sizes and/or forms. The cavities 5 could also be shaped as short or long grooves in the bombshell 4. Other geometrical shapes of the cavities 5 are also possible.

The positions of the cavities 5 on the bombshell 4 are adapted depending upon the strength of the bombshell 4. In areas with high mechanical strain or stress the distances between the cavities 5 are increased and in areas with low mechanical strain or stress the distances between the cavities are reduced 5. Topological optimization methods could be used to position the cavities 5 on the bombshell 4 in a way to increase the structural strength of the bombshell 4.

Projectiles 7 with the density, $\rho_{proj}$ are placed and fixed or bound to the preformed cavities 5. The projectiles 7 are shaped to only partly fill the cavities 5. The remaining space or volume of the cavities 5, not filled by the projectile 7, are filled by a filling material or agent 8 with the density, $\rho_{fill}$. The density of the projectiles 7 and the filling material or agent 8 are selected so that the weight of the material removed when pre-forming the cavities 5 in the bombshell 4 is equal to the weight of the added projectiles 7 and the added filler material or agent 8, i.e. the weight of the bomb is identical before and after pre-fragmentation is performed on the bomb 4. The density of the filling material or agent 8, $\rho_{fill}$, the bombshell $\rho_{shell}$ and the projectiles $\rho_{proj}$ are selected so that the relation $\rho_{fill}<\rho_{shell}<\rho_{proj}$ are fulfilled.

By adjusting the form, size and orientation of the cavities 5 and projectiles 7 when pre fragmentation is performed it is possible to affect the weapons effect and the direction of the weapons effect. In a first embodiment the cavities 5 are of a cylindrical shape and perpendicular oriented relative the longitudinal axis of the bomb 1 to achieve maximal lateral weapons effect.

In a second embodiment the cavities 5 and the projectiles 7 on the front portion of the bomb body 2 are arranged askew or aslant relative to the longitudinal axis of the bomb 1 to increase the weapons effect in the front direction of the bomb 1 and where the cavities 5 and the projectiles 7 on the rear portion of the bomb body 2 are arranged perpendicular oriented relative the longitudinal axis of the bomb 1 to achieve maximal lateral weapons effect. Inspection of the orientation of the cavities 5 and projectiles 7 could be performed, for example, with X-ray analysis.

The invention claimed is:

1. A method for pre-fragmenting a warhead including a warhead body, an explosive charge, a fin part, and a warhead shell with a density $P_{shell}$, wherein the warhead shell includes pre-formed cavities, each cavity including at least one pre-formed projectile with a density $P_{proj}$ and filler material or an agent with a density $P_{till}$, the method comprising:

pre-forming the cavities in the warhead shell;

arranging at least one projectile in each pre-formed cavity;

filling each cavity with the filler material or agent;

treating the filler material or agent so that the filler material or agent forms a connected structure with high adhesiveness to the projectiles and to the walls of the cavity, wherein the dimensions of the projectiles and the cavities and the density of the projectiles and the filler material or agent are selected so that the mass of the warhead before pre-fragmentation remains the same as after pre-fragmentation.

2. The method according to claim 1, wherein the density of the filler material or agent, the warhead shell, and the projectiles are selected to fulfill the relation $P_{fill}<P_{shell}<P_{proj}$.

3. The method according to claim 1, wherein the cavities are mechanically pre formed in the warhead shell by drilling or milling.

4. The method according to claim 1, wherein the filler material or agent are treated to a strong and continuous structure by heat and pressure treatment.

5. The method according to claim 1, wherein the filler material or agent are treated to a strong and continuous structure by a curing treatment.

6. The method according to claim 1, wherein the positions of the cavities on the warhead shell are selected depending upon the mechanical strength of the warhead shell by utilizing a topological optimization method.

7. A pre-fragmented warhead comprising:

a warhead body, a fin part, an explosive charge, and a warhead shell, the warhead shell having a thickness $t_{shell}$ and a density $P_{shell}$, wherein the warhead shell includes projectiles with a density $P_{proj}$ and filler material or an agent with a density $P_{till}$, wherein dimensions of the projectiles and the cavities and the density of the projectiles and the filler material or agent are selected so that a mass of the warhead before pre-fragmentation remains the same as after pre-fragmentation.

8. The pre-fragmented warhead according to claim 7, wherein the filler material or agent, the warhead shell, and the projectiles are selected to fulfil the relation $P_{fill}<P_{shell}<P_{proj}$.

9. The pre-fragmented warhead according to claim 7, wherein the projectiles are spherical with the diameter $d_{proj}$, and that the cavities are cylindrically shaped with the length $I_{cav}$ and the diameter $d_{cav}$, and where $d_{proj}<d_{cav}$.

10. The pre-fragmented warhead according to claim 7, wherein the projectile comprises an alloy of wolfram.

11. The pre-fragmented warhead (1) according to claim 7, wherein the filler material or agent comprises a magnesium powder.

12. The pre-fragmented warhead according to claim 7, wherein the filler material or agent comprises an aluminium powder.

13. The pre-fragmented warhead according to claim 7, wherein the filler material or agent comprises a zirconium powder.

14. The pre-fragmented warhead according to claim 7, wherein the filler material or agent comprises a thermosetting plastic.

15. The pre-fragmented warhead according to claim 7, wherein the warhead comprises a second warhead shell arranged on the first warhead shell.

16. The pre-fragmented warhead according to claim 7, wherein the warhead is a bomb.

17. The pre-fragmented warhead according to claim 7, wherein the warhead is a grenade.

* * * * *